United States Patent [19]

Sakata et al.

[11] Patent Number: 4,509,031

[45] Date of Patent: Apr. 2, 1985

[54] MAGNETIC ROLLER DEVICE

[75] Inventors: Yoshio Sakata, Kanagawa; Yasushi Kakehashi, Shiga, both of Japan

[73] Assignee: Kanegafuchi Kagaku Kogyo Kabushiki Kaisha, Osaka, Japan

[21] Appl. No.: 486,888

[22] Filed: Apr. 20, 1983

[30] Foreign Application Priority Data

Apr. 20, 1982 [JP] Japan ..... 57-65757

[51] Int. Cl.[3] ..... H01F 7/02

[52] U.S. Cl. ..... 335/306; 118/657; 355/3 DD

[58] Field of Search ..... 335/302, 303, 306; 355/3 DD; 118/657, 658

[56] References Cited

U.S. PATENT DOCUMENTS

| | | | |
|---|---|---|---|
| 3,168,686 | 2/1965 | King et al. | 335/306 |
| 3,454,913 | 7/1969 | Israelson et al. | 335/306 |
| 3,643,629 | 2/1972 | Kangas et al. | 335/303 X |
| 3,768,054 | 10/1973 | Neugebauer | 335/306 |
| 4,185,262 | 1/1980 | Watanabe et al. | 335/302 |
| 4,326,908 | 4/1982 | Hiya et al. | 335/302 X |

*Primary Examiner*—George Harris

*Attorney, Agent, or Firm*—Fleit, Jacobson, Cohn & Price

[57] ABSTRACT

At least one pair of adjacent magnets, magnet A of which serves both as an assistant magnet and a main magnet for a necessary magnetic pole is arranged so that it may have a magnetic component in the right angle direction with respect to the magnetized direction of another magnet B. Magnet A itself forms not only the main magnetic pole, but also is adapted to increase the flux density of magnet B in the outer circumference direction.

9 Claims, 4 Drawing Figures

MAGNETIC ROLLER DEVICE

BACKGROUND OF THE INVENTION

This invention relates to a magnetic device which requires the supply of a high flux density used for a magnetic roller, particularly for a plain paper copier.

In conventional magnetic rollers, a magnetic roller is well known wherein a sintered ferrite magnet having a rectangular cross-sectional area is adhered on a shaft by an aligned distribution with special form. However, such an arrangement significantly increases the manufacturing cost to form a shaft of special shape. In addition, the sintered ferrite magnet used is brittle and difficult to assemble. Further, defects can be caused by mechanical impact or vibration occurring after assembly. Furthermore, it is difficult to form a magnet having a profiled cross section because of the molding characteristics of sintered ferrite magnet material and the freedom in design of magnetic poles is very low. A magnet having a construction in the form of a plastic magnet in a bar shape, aligning it so that the direction of the magnetic poles thereof may be in the radial direction with respect to the central axis of the roller, and assembling it, is well known. However, in that case, it is very difficult to obtain a desired and sufficient magnetic flux density and the adjustment of the flux density is also different.

Furthermore, though a method of after-work is also provided in order to increase the magnetic flux density, it is not easy to accomplish.

Even in the case wherein a sintered ferrite magnet is employed, efforts to obtain a higher flux density are performed. In spite of such efforts, since a profiled magnet cannot be obtained when sintered ferrite is used, a method of assistant magnets is adopted in addition to the main magnets (magnets corresponding to or giving the necessary magnetic poles). However, this method is far more difficult in assembly and results in a considerably higher final cost.

SUMMARY OF THE INVENTION

This invention is performed from the above background in order to furnish a magnet roller having a high performance obtained by adapting it to a magnetic device so that a magnet corresponding to a necessary magnetic pole may be provided an operation as an assistant magnet mutually.

DETAILED DESCRIPTION OF THE INVENTION

Figure 1:
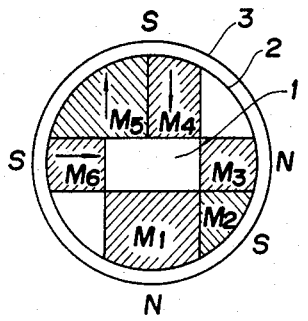
FIG. 1 is a cross-sectional view of an example of this invention.
Figure 3:
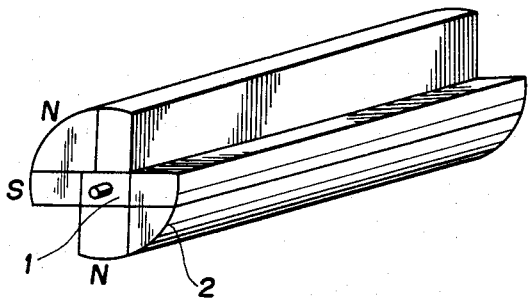
FIG. 3 is an external perspective view of the example.

This invention provides a magnetic device which it is possible to provide in practice without any difficulty of assembly by forming magnets corresponding to necessary numbers of magnetic poles at the circumference of a magnetic roller so as to act as assistant magnets thereby intending the same increase of magnetic flux density as that of a case wherein assistant magnets are mounted notwithstanding the configuration of the main magnet.

One of the features of the magnetic device of this invention is to form a magnetic circuit wherein together with at least one magnet, it forms an assistant magnet of other magnet as described above.

In order to realize that feature, it is necessary that each magnet has a required profile cross section. Accordingly, it is appropriate to form the device with a synthetic resin bonded magnet having good molding characteristics from the industrial point of view.

In order to provide high magnetic performance, it is desirable to use a so-called anisotropic bonded magnet molded from a synthetic resin composition containing anisotropic magnetic powders under a magnetic field. Generally, to form a magnet roller having a wide practical value, the maximum energy product of the magent necessitates more than $1.0\times10^6$ Gauss.Oerstead, preferably, more than $1.2\times10^6$ Gauss.Oersted. It is desirable to provide a magnet which contains 85 to 95 weight percent of magnetic powders, such as anistropic hard ferrite. The residual components which form the magnet may be provided singly or by mixing more than two kinds of resinous compounds from synthetic high polymers of homo- or copolymers of polymerizable compounds such as olefin, vinyl, or diene compounds, and the like, and synthetic polymers obtained by condensation of compounds having condensable functional groups, or chemically modified polymers from the above-mentioned polymers. In this case, from an industrial point of view, such as processability and other efficiencies, thermoplastic resins are desirable.

In the case of magnet molding the axes of easy magnetization (hereinafter called "easy axes") of anistropic magnetic powders are adapted to be oriented in one direction by molding the magnet while applying a magnetic field in one direction at a temperature at which a binder of synthetic polymer is kept fluid. In this invention, a mechanical orientation molding is not appropriate because magnets having a profiled cross section are employed. The molding method in the magnetic field may be selected from molding methods widely used for synthetic polymer molding. However, an extrusion or an injection molding method is desirable from the standpoints of the facility of the unit design and economy. To obtain efficient performance of the anisotropic magnet thus obtained, magnetization in the same direction as the magnetic orientation direction is preferable.

Further, the preferred embodiments of this invention is hereinafter described with reference to FIGS. 1 and 2. The illustrated embodiments are appropriate examples of this invention. In the drawing figures, the numeral 1 is a ferro-magnetic metal shaft and a plurality of magnets $M_1$ to $M_6$ (6 magnets in this example) are positioned at the circumference thereof. The outer circumference of the roller is defined by the exposed outer surfaces of the magnets. Each magnet $M_1$ to $M_6$ is magnetized in the direction shown by an arrow so as to orient the easy axis (the magnetized directions of each $M_1$ to $M_3$ are abridged in FIG. 1).

The above magnets $M_1$ to $M_6$ are main magnets and correspond to the necessary numbers of magnets at the circumferences of the magnet rollers. Further, in the above magnets (e.g., $M_5$ in FIG. 1 and $M_5$ in FIG. 2) one magnet (e.g., $M_5$) of at least one adjacent pair (e.g., magnets $M_5$ and $M_6$ in FIG. 1 and magnets $M_5$ and $M_4$ in FIG. 2) are one pair, respectively contact each other directly between said ferro-magnetic metal shaft 1 and the circumference 2 of the magnetic roller so that one magnet (e.g., $M_5$) may be an assistant magnet of another residual magnet (e.g., $M_6$ and $M_4$) and the magnets are aligned so that an angle between the magnetized direction of said mutual magnets and the orientation direction corresponding thereto may be a right angle. When one pair of adjacent magnets directly contact each other as shown in the example, the assistant magnet effect can be set most effectively. Accordingly, it is a necessary condition of the magnetic device according to this invention that said adjacent magnets sufficiently contact each other magnetically. Therefore, if there exists a gap between the adjacent magnets which form one pair, the assistant magnet effect can be obtained according to the degree of the gap as long as the leakage of the magnetic flux is not extremely large. It is a sufficient condition that both magnets only magnetically contact each other through a slight gap, even if both do not directly contact each other physically.

Further, when, for example, a magnet A which serves as an assistant magnet and a main magnet of one pair of the adjacent magents is aligned so that it may have a magnetic component in the right angle direction with respect to the magnetized direction of another magnet B, the magnet A itself not only forms a main magnet, but also increases the flux density given by magnet B in the outer circumference direction. Since the increasing degree thereof changes according to the strength of the magnetic component in said right angle direction, it is clear form this example that the most effective result can be obtained when said magnet B is aligned so that the magnetized direction thereof may be at a right angle with respect to the magnetized direction of magnet A.

In the examples, said each magnet $M_1$ to $M_6$ has a profiled cross section which together form a part of the circumference of the magnet roller with a surface of the magnet itself in order to realize the effect of this invention, and forms a permanent magent consisting of a resin bonded permanent magnet, for example, comprising hard ferrite particles and synthetic resin, wherein an easy axis is oriented in one direction (shown by the arrows) and is magnetized in the same direction thereto. Each magnet $M_1$ to $M_6$ has a bar shape formed by extrusion or injection molding. In this case, in order to magnetize it in one direction by orienting the easy axis in that direction, a status oriented in the magnetic field is formed. The value of maximum energy product thereof is desired to be more than $1.0\times1.0^6$ Gauss.Oersted, preferably more than $1.2\times10^6$ Gauss.Oersted. In this example, the magnets $M_1$ to $M_6$ are manufactured by taking the maximum energy product for forming the main magnetic poles as about $1.35\times10^6$ Gauss.Oersted and the measurement of magnetic characteristics is performed. The results are as follows. The outer diameters of the magnetic rollers in FIGS. 1 and 2 are around 35 mm. The measured values of the flux densities are those at positions apart from the outer circumference by 2.5 mm, namely that of the circle 3 having a 40 mm diameter.

Figure 2:
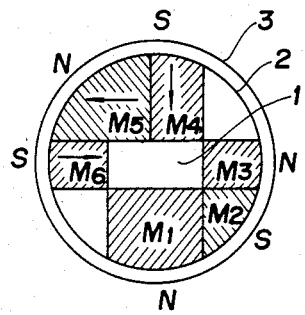
FIG. 2 is a cross-sectional view of another example.

| | $M_1$ | $M_2$ | $M_3$ | $M_4$ | $M_5$ | $M_6$ |
|---|---|---|---|---|---|---|
| FIG. 1 | 710 | 700 | 190 | 460 | 550 | 690 |
| FIG. 2 | 710 | 700 | 190 | 740 | 540 | 430 |

Figure 4:
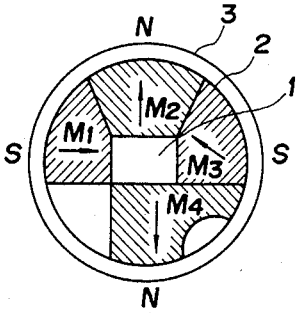
FIG. 4 is a cross-sectional view of another embodiment of this invention.

Judging from the result, it is clear that the magnetic flux density of the magnet ($M_6$ in FIG. 1 and $M_4$ in FIG. 2) having a magnetized direction which forms a right angle with that of the magnet 5, (this magnet itself is a main magnetic pole) and functions as an assistant magnet, is increased. FIG. 4 shows another embodiment of this invention. In FIG. 4, each magnet has main magnetic poles, $M_1$ and $M_3$ are the assistant magnet of $M_2$, and $M_4$ is the assistant magnet of $M_3$.

Thus, according to this invention, when a plurality of magnets are connected and configured around a ferro magnetic metal shaft to form a magnet roller, magnets corresponding to the necessary numbers of magnetic poles at the circumference of said magnetic substance rollers are provided, and said mutual magnets in at least one group of adjacent magnets are provided with a magnetically contacting portion without the aid of the ferro-magnetic metal shaft between said strong ferro-magnetic metal shaft and the circumference of the magnetic substance roller so that one magnet of at least one group of adjacent magnets may be an auxiliary magnetic pole in itself. The magnet which serves for the auxiliary magnetic pole additionally is aligned with the magnetized direction thereof and can have a magnetic component at a right angle direction with respect to the magnetized direction of another residual magnet. Accordingly, said magnet can obtain the effect of increasing the magnetic force in the easy axis direction in the point that said magnet has a function as the auxiliary pole of the adjacent magent together with being the main magnetic pole itself. In this case, there is no need of a complicated construction for securing another magnet for an auxiliary pole compared with the conventional one. Accordingly, it is very advantageous in manufacturing. Further, since the magnetic force increases by only mutual arrangement of the magnets, the resin bonded magnet also can be used to secure a sufficient and satisfactory magnet force without any additional work.

What is claimed is:

1. A magnet roller having contacting configurations of plural magnets around a ferro-magnetic metal shaft, said magnet roller comprising: a plurality of contacting magnets disposed about a ferro-magnetic shaft, the number of which magnets corresponds to the number of magnetic poles necessary at the circumference of said magnet roller, said magnets in at least one pair of adjacent magnets having magnetically contacting portions not only through the ferro-magnetic metal shaft but also between the said shaft and the said circumference so that one magnet of at least one pair of adjacent magnets is a magnet corresponding to a necessary magnetic pole and also is an assistant magnet for an adjacent magnet, and the magnet which serves as an assistant magnet additionally is aligned so that the magnetic flux thereof has a component along the rectangular direction of the magnetized direction of the other magnet.

2. A magnetic device according to claim 1 wherein the magnetized direction of the mutual magnets is aligned to be substantially at right angles.

3. A magnetic device according to claim 1 wherein said one pair of adjacent magnets have direct contact with a ferro-magnetic metal shaft and the circumference of a magnet roller.

4. A magnetic device according to claim 1 wherein said magnets are bar shaped resin bonded magnet profiles having axes of easy magnetization, the axes of the utilized magnetic powder particles being oriented in one direction, and magnetized in that direction.

5. A magnetic device according to claim 4 wherein said magnets are molded through magnetic orientation by molding under a magnetic field.

6. A magnetic device according to claim 5 wherein said magnets are molded from a composition comprising hard ferrite particles and synthetic resinous compounds.

7. A magnetic device according to claim 5 wherein said magnets are extruded.

8. A magnetic device according to claim 5 wherein said magnets are injection molded.

9. A magnetic roller including a plurality of elongated magnets arranged around a ferro-magnetic core, the number of magnets corresponding to the number of magnetic poles desired at the circumference of the roller, each said magnet having its axis of magnetization extending in a single direction, at least one pair of adjacent magnets positioned with their axes of magnetization substantially at right angles to each other, each of said magnets being in magnetic contact with adjacent magnets.

* * * * *